US011111568B2

(12) United States Patent
Shiga et al.

(10) Patent No.: US 11,111,568 B2
(45) **Date of Patent: *Sep. 7, 2021**

(54) STEEL FOR COLD FORGING AND MANUFACTURING METHOD THEREOF

(71) Applicant: NIPPON STEEL & SUMITOMO METAL CORPORATION, Tokyo (JP)

(72) Inventors: Akira Shiga, Tokyo (JP); Manabu Kubota, Tokyo (JP); Hajime Hasegawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 66 days.

This patent is subject to a terminal disclaimer.

(21) Appl. No.: 16/334,705

(22) PCT Filed: Sep. 30, 2016

(86) PCT No.: PCT/JP2016/079080

§ 371 (c)(1),
(2) Date: Mar. 19, 2019

(87) PCT Pub. No.: WO2018/061191

PCT Pub. Date: Apr. 5, 2018

(65) Prior Publication Data

US 2019/0264305 A1 Aug. 29, 2019

(51) Int. Cl.

| | |
|---|---|
| ***C22C 38/44*** | (2006.01) |
| ***B22D 27/04*** | (2006.01) |
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *C22C 38/44* (2013.01); *B22D 27/04* (2013.01); *C21D 8/00* (2013.01); *C21D 8/005* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C21D 2211/004* (2013.01)

(58) Field of Classification Search

None

See application file for complete search history.

(56) References Cited

U.S. PATENT DOCUMENTS

| | | | | |
|---|---|---|---|---|
| 2002/0044878 | A1 | 4/2002 | Yaguchi et al. | |
| 2004/0048217 | A1 | 3/2004 | Hayashi et al. | |
| 2009/0050241 | A1 | 2/2009 | Hashimura et al. | |
| 2009/0183802 | A1 | 7/2009 | Deura et al. | |
| 2013/0048156 | A1 | 2/2013 | Hashimura et al. | |
| 2013/0146180 | A1 | 6/2013 | Kubota | |
| 2013/0146181 | A1 | 6/2013 | Kubota | |
| 2013/0213199 | A1 | 8/2013 | Aiso et al. | |
| 2015/0044086 | A1 | 2/2015 | Miyanishi et al. | |
| 2015/0059933 | A1 | 3/2015 | Imataka et al. | |
| 2016/0060744 | A1 | 3/2016 | Kubota et al. | |
| 2016/0237515 | A1 | 8/2016 | Kajihara et al. | |
| 2017/0067140 | A1 | 3/2017 | Aiso et al. | |
| 2018/0057917 | A1 | 3/2018 | Matsui et al. | |
| 2018/0291486 | A1* | 10/2018 | Shiga | C22C 38/00 |
| 2018/0347025 | A1* | 12/2018 | Shiga | C23C 8/22 |
| 2018/0371603 | A1* | 12/2018 | Shiga | C23C 8/32 |

FOREIGN PATENT DOCUMENTS

| | | | |
|---|---|---|---|
| CN | 101184859 | A | 5/2008 |
| CN | 101492789 | A | 7/2009 |
| CN | 104120371 | A | 10/2014 |
| CN | 104204263 | A | 12/2014 |

(Continued)

OTHER PUBLICATIONS

English language machine translation of JP-2007031787-A to Murakami. Generated Nov. 21, 2020. (Year: 2020).*

English language machine translation of JP-2006249457-A to Murakami. Generated Nov. 21, 2020. (Year: 2020).*

"Low-alloyed steels for machine structural use", JIS G 4053, (2008), total of 78 pages.

"Vickers hardness test—Test method", JIS Z 2244, (2009), total of 98 pages.

International Search Report for PCT/JP2016/079080 (PCT/ISA/210) dated Dec. 6, 2016.

Isobe et al., "Analysis about behavior of formation of MnS during solidification of resulphurized free cutting steel", Journal of the Iron & Steel Institute of Japan, Sep. 1986, vol. 72, No. 12, p. 273.

Kurz et al., "Fundamentals of Solidification", Trans Tech Publications Ltd., (Switzerland), 1998, p. 256, total of 16 pages.

Written Opinion of the International Searching Authority for PCT/JP2016/079080 (PCT/ISA/237) dated Dec. 6, 2016.

(Continued)

*Primary Examiner* — Brian D Walck

(74) *Attorney, Agent, or Firm* — Birch, Stewart, Kolasch & Birch, LLP

(57) ABSTRACT

A steel for cold forging has a predetermined chemical composition, satisfies $d+3\sigma \leq 10.0$ and $SA/SB<0.30$, includes $1200/mm^2$ or more of sulfides having an equivalent circle diameter of 1.0 to 10.0 μm in a microstructure, and has an average distance between the sulfides of less than 30.0 μm. Here, d is an average value of equivalent circle diameters of sulfides having an equivalent circle diameter of 1.0 μm or more, σ is a standard deviation of the equivalent circle diameters of the sulfides having an equivalent circle diameter of 1.0 μm or more, SA is the number of sulfides having an equivalent circle diameter of 1.0 μm or more and less than 3.0 μm, and SB is the number of the sulfides having an equivalent circle diameter of 1.0 μm or more.

6 Claims, No Drawings

(56) References Cited

FOREIGN PATENT DOCUMENTS

| | | | | | |
|---|---|---|---|---|---|
| EP | 1059198 | A1 | | 1/2001 | |
| EP | 1507016 | A1 | | 2/2005 | |
| EP | 2816131 | A1 | | 12/2014 | |
| EP | 3382050 | A1 | | 10/2018 | |
| JP | 2-228447 | A | | 9/1990 | |
| JP | 10-296396 | A | | 11/1998 | |
| JP | 2000-282171 | A | | 10/2000 | |
| JP | 2000-319751 | A | | 11/2000 | |
| JP | 2001-131684 | A | | 5/2001 | |
| JP | 2001-234279 | A | | 8/2001 | |
| JP | 2002-89589 | A | | 3/2002 | |
| JP | 2003-293081 | A | | 10/2003 | |
| JP | 2003-301238 | A | | 10/2003 | |
| JP | 2005-232508 | A | | 9/2005 | |
| JP | 2006249457 | A | * | 9/2006 | |
| JP | 2007031787 | A | * | 2/2007 | ..... C23C 8/22 |
| JP | 3893756 | B2 | | 3/2007 | |
| JP | 2011-167698 | A | | 9/2011 | |
| JP | 2011-184768 | A | | 9/2011 | |
| JP | 2012-35286 | A | | 2/2012 | |
| JP | 4924422 | B2 | | 4/2012 | |
| JP | 2013-18999 | A | | 1/2013 | |
| JP | 5114689 | B2 | | 1/2013 | |
| JP | 5114753 | B2 | | 1/2013 | |
| JP | 5135562 | B2 | | 2/2013 | |
| JP | 5135563 | B2 | | 2/2013 | |
| JP | 5458048 | B2 | | 4/2014 | |
| JP | 5545273 | B2 | | 7/2014 | |
| JP | 2015-006680 | A | | 1/2015 | |
| JP | 2015-7278 | A | | 1/2015 | |
| KR | 10-2005-0075019 | A | | 7/2005 | |
| KR | 10-2016-0111486 | A | | 9/2016 | |
| RU | 2060294 | C1 | | 5/1996 | |
| WO | WO 02/44436 | A1 | | 6/2002 | |
| WO | WO 2012/108460 | A1 | | 8/2012 | |
| WO | WO 2012/108461 | A1 | | 8/2012 | |
| WO | WO 2013/121930 | A1 | | 8/2013 | |
| WO | WO 2015/060223 | A1 | | 4/2015 | |
| WO | WO 2015/125915 | A1 | | 8/2015 | |

OTHER PUBLICATIONS

European Search Report dated Feb. 19, 2020, issued in European Patent Application No. 16917741.7.

Manfred Kodym et al.; Autorenkollektiv: "Spurenelemente im Stahl-Moeglichkeiten zur Beeinflussung im Smelzbetrieb", Spurenelemente in Staehlen, Verlag Stahleisen, Duesseldorf, DE, Jan. 1, 1985, pp. 19-22.

Chinese Office Action and Search Report dated Jul. 10, 2019 for Chinese Application No. 201680060712.X, with English translation of the Search Report.

Chinese Office Action and Search Report dated Jul. 26, 2019, for Chinese Application No. 201680069891.3, with English translation.

Extended European Search Report for European Application No. 16857251.9, dated May 13, 2019.

Extended European Search Report, dated Apr. 18, 2019, for European Application No. 16868674.9.

International Search Report for PCT/JP2016/079052 (PCT/ISA/210) dated Dec. 20, 2016.

International Search Report for PCT/JP2016/084977 dated Feb. 14, 2017.

Japanese Office Action dated Jan. 29, 2019, issued in Japanese Patent Application 2017-546476.

Korean Office Action dated Aug. 1, 2019, for Application No. 10-2018-7016250, with English translation.

Non Final Office Action dated Feb. 14, 2020, issued in U.S. Appl. No. 15/767,042.

Notice of Allowance dated Dec. 27, 2019, issued in U.S. Appl. No. 15/777,746.

Notice of Allowance dated Jul. 16, 2020, issued in U.S. Appl. No. 15/767,042.

Shao et al., "Morphology Evolution of MnS inclusions in Hot Forging Steel by Heat Treatment", Current advances in materials and processes, Mar. 1, 2011, vol. 24, No. 1, pp. 521-524.

Written Opinion of the International Searching Authority for PCT/JP2016/079052 (PCT/ISA/237) dated Dec. 20, 2016.

Written Opinion of the International Searching Authority for PCT/JP2016/084977 (PCT/ISA/237) dated Feb. 14, 2017.

* cited by examiner

STEEL FOR COLD FORGING AND MANUFACTURING METHOD THEREOF

TECHNICAL FIELD OF THE INVENTION

The present invention relates to a steel for cold forging and a manufacturing method thereof.

RELATED ART

Steel for machine structural use is used for mechanical components of industrial machinery, construction machinery, transportation machinery typified by automobiles, and the like. Steel for machine structural use is generally rough-processed by hot forging and then machined into finished mechanical components having a predetermined shape. Therefore, workability and machinability are required for the steel for machine structural use.

Cold forging has higher dimensional accuracy than hot forging and thus has an advantage that a machining amount after forging can be reduced, and the like. Therefore, in recent years, there have been an increasing number of components rough-formed by cold forging in the rough processing. However, when cold forging is performed, cracking is more likely to occur in steel compared to a case where hot forging is performed. Therefore, steel for cold forging used for cold forging is required to have a property that is less likely to cause cracking during cold forging (hereinafter, referred to as cold forgeability) as well as machinability.

In a case of rough-forming steel by cold forging, in order to improve cold forgeability by decreasing deformation resistance in forging, spheroidizing annealing is widely performed before forging. However, when spheroidizing annealing is performed on steel, there is a problem that machinability during machining after cold forging decreases.

When sulfur (S) is contained in steel, S is bonded to manganese (Mn) in steel to form sulfide-based inclusions (hereinafter, referred to as sulfides) primarily containing a sulfide. It is well known that such sulfides improve machinability. Therefore, to increase the machinability, it is conceivable to increase the S content. However, when the S content is increased, a large amount of coarse sulfides (MnS, CaS, and the like) are generated and the cold forgeability is decreased.

Therefore, in the related art, it is difficult to improve both the cold forgeability and machinability. In steel for cold forging in the related art, the decrease in cold forgeability and fatigue strength is suppressed by reducing the S content, resulting in low machinability.

Patent Documents 1 and 2 suggest techniques for improving the machinability of steel by morphology control of sulfides and the like. For example, Patent Document 1 discloses a case hardening steel which is improved in machinability by controlling the solidification rate during casting and finely dispersing sulfide so as to suppress coarsening of the sulfides. In addition, Patent Document 2 discloses a case hardening steel which is improved in machinability by dispersing sulfides in sub-micron levels.

However, although the machinability after hot forging has been examined in Patent Documents 1 and 2, no consideration is given to machinability after spheroidizing annealing and cold forging. Furthermore, in Patent Document 2, cold forgeability is not considered.

Patent Documents 3 and 4 disclose free cutting steels which are improved in chip disposability by reducing the intergranular distance of sulfide-based inclusions.

However, in the techniques disclosed in Patent Documents 3 and 4, in a case where coarse sulfides are present, a small intergranular distance facilitates the occurrence of cracking during cold forging, and there is concern that the cold forgeability may decrease. In addition, although the machinability after hot forging is considered in Patent Document 3, no consideration is given to machinability after spheroidizing annealing and cold forging.

As described above, in the related art, steel for cold forging having improved machinability has not been obtained without impairing cold forgeability.

PRIOR ART DOCUMENT

Patent Document

[Patent Document 1] Japanese Patent No. 5114689
[Patent Document 2] Japanese Patent No. 5114753
[Patent Document 3] Japanese Unexamined Patent Application, First Publication No. 2000-282171
[Patent Document 4] Japanese Patent No. 4924422

DISCLOSURE OF THE INVENTION

Problems to be Solved by the Invention

The present invention has been made taking the foregoing circumstances into consideration. An object of the present invention is to provide a steel for cold forging excellent in cold forgeability and machinability and a manufacturing method thereof.

Means for Solving the Problem

The inventors conducted researches and examinations regarding steel for cold forging, and obtained the following findings.

(a) Annealing (spheroidizing annealing) before cold forging is effective for improving the cold forgeability of steel. However, when annealing is performed, since the ductility of the steel is improved, chips during cutting become long and chip disposability deteriorates. In addition, the surface roughness of the steel after cutting also increases.

(b) Cutting is a fracture phenomenon that separates chips, and in order to promote the separating, it is effective to embrittle a matrix (base metal). By finely dispersing sulfides, it is possible to facilitate fracture and improve chip disposability. Furthermore, when the intergranular distance between the sulfides is short, the chip separability is improved. On the other hand, when a small amount of the large sulfides is dispersed, the interval between the sulfides acting as the origin of chip separation becomes long, and as a result, the chips tend to become long.

(c) The inventors conducted various experiments on the relationship between the equivalent circle diameter of sulfides and chip disposability. As a result, it was found that among sulfides having an average equivalent circle diameter of 1.0 μm or more, when the number fraction of sulfides having an average equivalent circle diameter of less than 3.0 μm exceeds 30%, the chip disposability decreases. That is, it was found that by reducing extremely fine sulfides, excellent machinability can be obtained with a smaller total amount of sulfides. It is considered that this is because fine sulfides having an average equivalent circle diameter of less than 3.0 μm are less likely to effectively act as a stress concentration source during chip separation.

(d) It is presumed that cracking during cold forging, which is an index of cold forgeability, occurs by the following mechanism. That is, when a void is formed at the boundary between a coarse sulfide and a matrix (primary phase), and as a plurality of voids are connected, a crack is formed. The crack propagates as plastic deformation progresses. As the cracks are connected, cracking occurs. Therefore, in order to improve cold forgeability, it is important to reduce the amount of coarse sulfides.

(e) Furthermore, the inventors conducted various experiments on the relationship between the maximum sulfide size and the cold forgeability. As a result, it was found that when the maximum equivalent circle diameter of observed sulfides exceeds 10.0 μm, cold forgeability decreases.

(f) Sulfides in steel tend to crystallize before solidification (in molten steel) or during solidification, and the size of the sulfides is greatly affected by the cooling rate during solidification. In addition, the solidification structure of a continuous cast piece usually has a dendrite morphology, the dendrite is formed due to the diffusion of solute elements in the solidification process, and the solute elements are enriched in between dendrite arms. That is, Mn is enriched in between dendrite arms and Mn sulfide crystallizes between the arms.

(g) In order to finely disperse the Mn sulfide, it is necessary to shorten the interval between the dendrite arms. The primary arm spacing of a dendrite has been hitherto studied, and according to Non-Patent Document below, can be expressed by Expression (A).

$$\lambda \propto (D \times \sigma \times \Delta T)0.25 \quad (A)$$

where λ is the primary arm spacing (μm) of the dendrite, D is the diffusion coefficient ($m^2/s$), σ is the solid-liquid interface energy ($J/m^2$), and ΔT is the solidification temperature range (° C.).

Non-Patent Document: W. Kurz and D. J. Fisher, "Fundamentals of Solidification", Trans Tech Publications Ltd., (Switzerland), 1998, p. 256

From Expression (A), it can be seen that the primary arm spacing λ of the dendrite depends on the solid-liquid interface energy σ, and it can be seen that λ decreases as σ decreases. If λ can be decreased, the size of Mn sulfide crystallized between the dendrite arms can be reduced.

The inventors newly found that by including a small amount of Bi in steel, the solid-liquid interface energy can be reduced, and the size of sulfides can be refined.

The present invention has been completed based on the above findings, and the gist thereof is as follows (1) to (5).

(1) According to an aspect of the present invention, a steel for cold forging includes, as a chemical composition, by mass %, C: 0.05% to 0.30%, Si: 0.05% to 0.45%, Mn: 0.40% to 2.00%, S: 0.008% to less than 0.040%, Cr: 0.01% to 3.00%, Al: 0.010% to 0.100%, Bi: 0.0001% to 0.0050%, Mo: 0% to 1.00%, Ni: 0% to 1.00%, V: 0% to 0.30%, B: 0% to 0.0200%, Mg: 0% to 0.0035%, Ti: 0% to 0.060%, Nb: 0% to 0.080%, and a remainder of Fe and impurities, in which N, P, and O contained in the impurities are as follows N: 0.0250% or less, P: 0.050% or less, and O: 0.0020% or less, the chemical composition satisfies Expression (1) and Expression (2), $1200/mm^2$ or more of sulfides having an equivalent circle diameter of 1.0 to 10.0 μm are contained in a microstructure, and an average distance between the sulfides is less than 30.0 μm, $$d+3\sigma \leq 10.0 \quad (1)$$

$$SA/SB < 0.30 \quad (2)$$

in the Expression (1), d is an average value of equivalent circle diameters of the sulfides having an equivalent circle diameter of 1.0 μm or more, σ is a standard deviation of the equivalent circle diameters of the sulfides having the equivalent circle diameter of 1.0 μm or more, in the Expression (2), SA is a number of sulfides having the equivalent circle diameter of 1.0 μm or more and less than 3.0 μm, and SB is a number of sulfides having an equivalent circle diameter of 1.0 μm or more.

(2) The steel for cold forging according to (1) may include, as the chemical composition, by mass %, one or two or more selected from the group consisting of Mo: 0.02% to 1.00%, Ni: 0.10% to 1.00%, V: 0.03% to 0.30%, B: 0.0005% to 0.0200%, and Mg: 0.0001% to 0.0035%.

(3) The steel for cold forging according to (1) or (2) may include, as the chemical composition, by mass %, one or two selected from the group consisting of Ti: 0.002% to 0.060%, and Nb: 0.010% to 0.080%.

(4) According to another aspect of the present invention, a manufacturing method of a steel for cold forging includes: casting a cast piece having the chemical composition according to any one of (1) to (3), and having a dendrite primary arm spacing of less than 600 μm in a range of 15 mm from a surface of the cast piece; performing a hot working on the cast piece to obtain a steel material; and annealing the steel material.

(5) In the manufacturing method of a steel for cold forging according to (4), in the casting, an average cooling rate in a temperature range from a liquidus temperature to a solidus temperature at a depth of 15 mm from the surface of the cast piece may be set to 120° C./min to 500° C./min.

Effects of the Invention

According to the aspects of the present invention, it is possible to provide the steel for cold forging excellent in cold forgeability and machinability and the manufacturing method thereof.

The steel for cold forging according to the aspect of the present invention is excellent in machinability when a rough formed article formed by cold forging after annealing is machined directly or after normalizing as necessary. Therefore, the proportion of machining costs to the manufacturing costs of steel product components such as gears, shafts, and pulleys for automobiles and industrial machinery can be reduced, and the quality of the components can be improved.

In addition, in the manufacturing method of a steel for cold forging according to the aspect of the present invention, since the cast piece having the predetermined chemical composition is cast, the dendrite structure which becomes the crystallization nucleus of sulfides is refined, so that the sulfides in the steel are finely dispersed. Therefore, a steel for cold forging excellent in machinability after cold forging, that is, machinability before carburizing, carbonitriding, or nitriding, which becomes the material of steel product components such as gears, shafts, and pulleys can be obtained.

EMBODIMENTS OF THE INVENTION

Hereinafter, a steel for cold forging according to an embodiment of the present invention (a steel for cold forging according to this embodiment) will be described in detail.

In order to work the steel for machine structural use such as case hardening steel into a component shape such as a gear, a continuously cast piece is rolled, is thereafter subjected to hot forging or cold forging, is then cut, and is furthermore subjected to a surface-hardening treatment such as carburizing quenching. Although sulfides in steel decrease cold forgeability, the sulfides are extremely effective in improving machinability. Sulfides in the case hardening steel as a work material suppress a tool change due to the wear of a cutting tool and has an effect of increasing a so-called tool life.

Machinability and cold forgeability will be further described.

From the viewpoint of machinability, it is important to increase the S content. Including S improves the tool life and chip disposability during cutting. This effect is determined by the total amount of the S content, and is hardly affected by the shape of the sulfides. Therefore, in order to improve the machinability, it is desirable to generate sulfides in the steel.

On the other hand, regarding sulfides in steel, the sulfides themselves deform during cold forging and become the origin of fracture. In particular, coarse sulfides significantly reduce cold forgeability such as limit compression ratio. Specifically, when the maximum equivalent circle diameter of sulfides observed with an optical microscope exceeds 10.0 μm, such sulfides tend to become the origin of the occurrence of cracking during cold forging. In addition, when hot working such as hot rolling or hot forging is performed in a process of manufacturing case hardening steel, coarse sulfides tend to stretch and cause the decrease in machinability. Therefore, in the steel for cold forging according to this embodiment, it is desirable to refine sulfides.

In order to suppress the coarsening of sulfides, it is desirable to reduce the solid-liquid interface energy in molten steel to refine the dendrite structure of a cast piece after casting. The dendrite structure greatly influences the grain size of the sulfides, and the grain size of the sulfides decreases as the dendrite structure is refined.

In order to finely disperse the sulfides stably and effectively, it is preferable to add a small amount of Bi to reduce the solid-liquid interface energy in the molten steel. This is because when the solid-liquid interface energy decreases, the dendrite structure is refined, and the sulfides crystallized from the dendrite structure are also refined.

When the S content is increased, the machinability improves but the cold forgeability decreases. On the other hand, in a case of comparing steels containing the same amount of S, the steel with finer sulfides exhibits better cold forgeability. For this reason, it is possible to improve both cold forgeability and machinability by increasing the S content and refining the sulfides.

Therefore, the steel for cold forging according to this embodiment has a predetermined chemical composition, in a case where d is the average value of the equivalent circle diameters of the sulfides, σ is the standard deviation of the equivalent circle diameters of the sulfides, SA is the number of sulfides having an equivalent circle diameter of 1.0 μm or more and less than 3.0 μm, and SB is the number of sulfides having an equivalent circle diameter of 1.0 μm or more, $d+3\sigma \leq 10.0$ and $SA/SB < 0.30$ are satisfied, 1200/mm$^2$ or more of sulfides having an equivalent circle diameter of 1.0 to 10.0 μm are contained in a microstructure, and the average distance between the sulfides is less than 30.0 μm.

Hereinafter, the steel for cold forging according to this embodiment will be further described. First, the amount of each element sill be described. Here, "%" for the element is mass % unless otherwise specified.

C: 0.05% to 0.30%

Carbon (C) increases the tensile strength and fatigue strength of steel. Therefore, the C content is set to 0.05% or more. The C content is preferably 0.10% or more, and more preferably 0.15% or more. On the other hand, when the C content is too large, the cold forgeability of the steel decreases and the machinability also decreases. Therefore, the C content is 0.30% or less. The C content is preferably 0.28% or less, and more preferably 0.25% or less.

Si: 0.05% to 0.45%

Silicon (Si) forms a solid solution in ferrite in steel and increases the tensile strength of the steel. Therefore, the Si content is set to 0.05% or more. The Si content is preferably 0.15% or more, and more preferably 0.20% or more. On the other hand, when the Si content is too large, the cold forgeability of the steel decreases. Therefore, the Si content is 0.45% or less. The Si content is preferably 0.40% or less, and more preferably 0.35% or less.

Mn: 0.40% to 2.00%

Manganese (Mn) increases the tensile strength and fatigue strength of steel by forming a solid solution in the steel, and improves the hardenability of the steel. Mn is further bonded to sulfur (S) in the steel to form Mn sulfide, which increases the machinability of the steel. Therefore, the Mn content is set to 0.40% or more. In a case of increasing the tensile strength, fatigue strength, and hardenability of the steel, a preferable Mn content is 0.60% or more, and a more preferable Mn content is 0.75% or more. On the other hand, when the Mn content is too large, the cold forgeability of the steel decreases. Therefore, the Mn content is 2.00% or less. In a case of further increasing the cold forgeability of the steel, a preferable Mn content is 1.50% or less, and a more preferable Mn content is 1.20% or less.

S: 0.008% or More and Less Than 0.040%

Sulfur (S) is bonded to Mn in steel to form Mn sulfide, which increases the machinability of the steel. Therefore, the S content is set to 0.008% or more. In a case of further increasing the machinability of the steel, a preferable S content is 0.010% or more, and a more preferable S content is 0.015% or more. On the other hand, when S is excessively contained, the cold forgeability and fatigue strength of the steel are decreased. Therefore, the S content is less than 0.040%. In a case of further increasing the cold forgeability of steel, a preferable S content is less than 0.030%, and a more preferable S content is less than 0.025%.

Cr: 0.01% to 3.00%

Chromium (Cr) increases the hardenability of steel, and increases the tensile strength and surface hardness of the steel after a carburizing treatment or induction hardening. There may be cases where the surface of steel of mechanical components manufactured by the steel for cold forging according to this embodiment is hardened by the carburizing treatment or induction hardening. Therefore, in order to obtain these effects, the Cr content is set to 0.01% or more. In a case of further increasing the hardenability and tensile strength of the steel, a preferable Cr content is 0.03% or more, and a more preferable Cr content is 0.10% or more. On the other hand, when the Cr content is too large, the cold forgeability and fatigue strength of the steel are decreased. Therefore, the Cr content is 3.00% or less. In a case of further increasing the cold forgeability and fatigue strength, a preferable Cr content is 2.00% or less, a more preferable Cr content is 1.50% or less, and an even more preferable Cr content is 1.20% or less.

Al: 0.010% to 0.100%

Al is an element having a deoxidizing action. In addition, Al is an element which is bonded to N to form AlN and is thus effective for preventing coarsening of austenite grains during carburizing heating. However, when the Al content is less than 0.010%, coarsening of austenite grains cannot be stably prevented. In a case where austenite grains are coarsened, the bending fatigue strength decreases. Therefore, the Al content is set to 0.010% or more. The Al content is preferably 0.030% or more. On the other hand, when the Al content exceeds 0.100%, coarse oxides tend to be formed and bending fatigue strength decreases. Therefore, the Al content is set to 0.100% or less. A preferable upper limit of the Al content is 0.060%.

Bi: 0.0001% to 0.0050%

Bi is an important element in the present invention. By including a small amount of Bi, the solidification structure of the steel is refined, and as a result, the sulfides are finely dispersed. In order to obtain the refinement effect of the Mn sulfides, the Bi content needs to be 0.0001% or more. In order to further improve the machinability, it is preferable to set the Bi content to 0.0010% or more. On the other hand, when the Bi content exceeds 0.0050%, the refinement effect of the dendrite structure is saturated, and the hot workability of the steel deteriorates, so that hot rolling becomes difficult. Therefore, the Bi content is set to 0.0050% or less. The Bi content may be 0.0048% or less.

N: 0.0250% or Less

Nitrogen (N) is contained as an impurity. Solid soluted N in steel increases the deformation resistance of the steel during cold forging and decreases the cold forgeability. In a case where B is contained, when the N content is large, BN is formed, and the effect of improving the hardenability of B is decreased. Therefore, in a case where B is contained, in a case where Ti and Nb are not contained, the N content is preferably as small as possible. Therefore, the N content is set to 0.0250% or less. A preferable N content is 0.0180% or less, and a more preferable N content is 0.0150% or less. Since a smaller N content is preferable, the N content may be 0%.

On the other hand, when N is contained together with Ti or Nb, nitrides or carbonitrides generated, so that austenite grains are refined and the cold forgeability and fatigue strength of the steel are increased. In a case where B is not contained and Ti or Nb is contained to aggressively generate nitrides or carbonitrides, 0.0060% or more of N may be contained.

P: 0.050% or Less

Phosphorus (P) is an impurity. P lowers the cold forgeability and hot workability of steel. Therefore, the P content is preferably small. When the P content exceeds 0.050%, the cold forgeability and the hot workability significantly decrease, so that the P content is set to 0.050% or less. A preferable P content is 0.035% or less, and a more preferable P content is 0.020% or less. Since a smaller P content is preferable, the P content may be 0%.

O: 0.0020% or Less

O (oxygen) is bonded to Al to form hard oxide-based inclusions, which lowers the bending fatigue strength. In particular, when the O content exceeds 0.0020%, the fatigue strength decreases significantly. Therefore, the O content is set to 0.0020% or less. The O content as an impurity element is preferably set to 0.0010% or less, more desirably as small as possible within a range not causing an increase in cost in a steelmaking process, and may be 0%.

The remainder of the chemical composition of the steel for cold forging according to this embodiment is basically consisting of Fe and impurities. The impurities mentioned here refer to elements incorporated from ores or scrap used as raw materials of steel, or from environments in a manufacturing process and the like. In the present embodiment, examples of the impurities include copper (Cu) and nickel (Ni) in addition to P, O, and N mentioned above. The Cu and Ni contents as the impurities are about the same as the Cu and Ni contents in SCr steels and SCM steels specified in JIS G 4053: Low-alloyed steels for machine structural use, and it is preferable that the Cu content is 0.30% or less and the Ni content is 0.25% or less.

[Selected Elements]

The steel for cold forging according to this embodiment may further contain one or two or more selected from the group consisting of Mo, V, B, Mg, Ti, and Nb in addition to the above-mentioned elements in ranges described later, instead of a portion of Fe. All of Mo, V, B, and Mg are effective for increasing the fatigue strength of steel. In addition, Ti and Nb are effective for increasing the cold forgeability and fatigue strength of the steel. However, since these elements are not necessarily contained, the lower limit thereof is 0%.

Mo: 0% to 1.00%

Molybdenum (Mo) increases the hardenability of steel and increases the fatigue strength of the steel. In addition, Mo suppresses a slack-quenched layer in a carburizing treatment. The above effect can be obtained if even a small amount of Mo is contained. When the Mo content is 0.02% or more, the above effect is significantly obtained, which is preferable. The Mo content is more preferably 0.05% or more. On the other hand, when the Mo content is too large, the machinability of the steel decreases. Furthermore, the manufacturing cost of the steel also increases. Therefore, even in a case where Mo is contained, the Mo content is 1.00% or less. The Mo content is preferably 0.50% or less, and more preferably 0.30% or less.

Ni: 0% to 1.00%

Nickel (Ni) has an effect of increasing the hardenability of steel and is an element effective for further increasing the fatigue strength. Therefore, Ni may be contained as necessary. In order to stably obtain the effect of increasing the fatigue strength by improving the hardenability by Ni, the Ni content is preferably 0.10% or more. However, when the Ni content exceeds 1.00%, not only is the effect of increasing the fatigue strength due to the improvement of hardenability saturated, but also the deformation resistance increases, resulting in a significant decrease in cold forgeability. Therefore, the amount of Ni in a case of being contained is set to 1.00% or less. The amount of Ni in a case of being contained is preferably 0.80% or less.

V: 0% to 0.30%

Vanadium (V) forms carbides in steel and increases the fatigue strength of the steel. Vanadium carbides precipitate in ferrite and increases the strength of the core portion (the portion other than the surface layer) of the steel. If even a small amount of V is contained, the above effect can be obtained. When the V content is 0.03% or more, the above effect is significantly obtained, which is preferable. The V content is more preferably 0.04% or more, and even more preferably 0.05% or more. On the other hand, when the V content is too large, the cold forgeability and fatigue strength of the steel are decreased. Therefore, even in a case where V is contained, the V content is 0.30% or less. The V content is preferably 0.20% or less, and more preferably 0.10% or less.

B: 0% to 0.0200%

Boron (B) increases the hardenability of steel and increases the fatigue strength. If even a small amount of B is contained, the above effect can be obtained. When the B content is 0.0005% or more, the above effect is significantly obtained, which is preferable. The B content is more preferably 0.0010% or more, and even more preferably 0.0020% or more. On the other hand, when the B content exceeds 0.0200%, the effect is saturated. Therefore, even in a case where B is contained, the B content is 0.0200% or less. The B content is preferably 0.0120% or less, and more preferably 0.0100% or less.

Mg: 0% to 0.0035%

Like Al, magnesium (Mg) deoxidizes steel and refines oxides in the steel. As the oxides in the steel are refined, the probability that coarse oxides may become the origin of fracture decreases, and the fatigue strength of the steel increases. If even a small amount of Mg is contained, the above effect can be obtained. When the Mg content is 0.0001% or more, the above effect is significantly obtained, which is preferable. The Mg content is more preferably 0.0003% or more, and even more preferably 0.0005% or more. On the other hand, when the Mg content is too large, the above effect is saturated and the machinability of the steel decreases. Therefore, even in a case where Mg is contained, the Mg content is 0.0035% or less. The Mg content is preferably 0.0030% or less, and more preferably 0.0025% or less.

Ti: 0% to 0.060%

Titanium (Ti) is an element that forms fine carbides, nitrides, and carbonitrides in steel and refines austenite grains by the austenite pinning effect. When the austenite grains are refined, the cold forgeability and fatigue strength of the steel are increased. If even a small amount of Ti is contained, the above effect can be obtained. When the Ti content is 0.002% or more, the above effect is significantly obtained, which is preferable. The Ti content is more preferably 0.005% or more, and even more preferably 0.010% or more. On the other hand, when the Ti content is too large, the machinability and the cold forgeability of the steel decrease. Therefore, even in a case where Ti is contained, the Ti content is 0.060% or less. The Ti content is preferably 0.040% or less, and more preferably 0.030% or less.

Nb: 0% to 0.080%

Like Ti, niobium (Nb) forms fine carbides, nitrides, and carbonitrides to refine austenite grains, thereby increasing the cold forgeability and fatigue strength of the steel. If even a small amount of Nb is contained, the above effect can be obtained. When the Nb content is 0.010% or more, the above effect is significantly obtained, which is preferable. The Nb content is more preferably 0.015% or more, and even more preferably 0.020% or more. On the other hand, when the Nb content is too large, the above effect is saturated and the machinability of the steel decreases. Therefore, even in a case where Nb is contained, the Nb content is 0.080% or less. The Nb content is preferably 0.050% or less, and more preferably 0.040% or less.

As described above, the steel for cold forging according to this embodiment has a chemical composition including the basic elements mentioned above and the remainder of Fe and impurities, or a chemical composition including the basic elements mentioned above, at least one selected from the selected elements mentioned above, and the remainder of Fe and impurities.

Next, the structure of the steel for cold forging according to this embodiment will be described.

[1200/mm$^2$ or More of Sulfides Having Equivalent Circle Diameter of 1.0 to 10.0 μm Are Contained in Microstructure]

Sulfides are useful for improving machinability. However, when the S content is increased, the machinability is improved, but the amount of coarse sulfides increases. Coarse sulfides stretched by hot rolling or the like impair the cold forgeability. Therefore, it is necessary to control the size and number density of the sulfides. Specifically, in the steel for cold forging according to this embodiment, the sulfides having an equivalent circle diameter of 1.0 to 10.0 μm in the microstructure are set to 1200/mm$^2$ or more. When the number density of sulfides having an equivalent circle diameter of 1.0 to 10.0 μm is less than 1200/mm$^2$, the number of sulfides contributing to chip separation is insufficient, and the machinability deteriorates, which is not preferable. There is no need to limit the upper limit, but it is difficult to set the number density to more than 2000/mm$^2$. Sulfides having an equivalent circle diameter of 1.0 to 10.0 μm are targeted because sulfides of more than 10.0 μm become the origin of fracture and even when small sulfides of less than 1.0 μm are controlled, there is no effect on the cold forgeability and chip disposability. An increase in the number density of sulfides of less than 1.0 μm or an increase in the number density of sulfides of more than 10.0 μm leads to a decrease in the number density of sulfides having an equivalent circle diameter of 1.0 to 10.0 μm, which is not preferable.

The equivalent circle diameter of the sulfide is the diameter of a circle having the same area as the area of the sulfide, and can be obtained by image analysis. Similarly, the number of sulfides can be obtained by image analysis. In addition, it can be confirmed that inclusions are sulfides by energy dispersive X-ray spectroscopy with a scanning electron microscope.

[Average Distance between Sulfides is Less than 30.0 μm]

Furthermore, in order to improve the chip disposability during machining, it is necessary to disperse fine sulfides. That is, it is important to reduce the interval between the sulfides. Specifically, the average distance between the sulfides needs to be less than 30.0 μm. The inventors conducted various experiments on the relationship between the average distance between sulfides (the intergranular distance between sulfides) and chip disposability, and as a result, confirmed that when the intergranular distance between the sulfides is less than 30.0 μm, good chip disposability can be obtained. On the other hand, when the average distance between the sulfides decreases, the sulfides tend to become the origin of fracture. Therefore, the average distance is preferably 10.0 μm.

The intergranular distance between the sulfides can be obtained by image analysis.

$$[d+3\sigma \leq 10.0]$$

$$[SA/SB < 0.30]$$

In the steel for cold forging in this embodiment, Expressions (1) and (2) need to be further satisfied.

$$d+3\sigma \leq 10.0(\mu m) \quad (1)$$

$$SA/SB < 0.30 \quad (2)$$

Here, in Expression (1), d is the average value (μm) of the equivalent circle diameters of sulfides having an equivalent circle diameter of 1.0 μm or more, and σ is the standard deviation of the equivalent circle diameters of sulfides having an equivalent circle diameter of 1.0 μm or more. In addition, in Expression (2), SA is the number of sulfides having an equivalent circle diameter of 1.0 μm or more and less than 3.0 μm, and SB is the number of sulfides having an equivalent circle diameter of 1.0 μm or more.

The equivalent circle diameter of the sulfide is the diameter of a circle having the same area as the area of the sulfide, and can be obtained by image analysis. Similarly, the number of sulfides and the intergranular distance between the sulfides can also be obtained by image analysis. Specifically, these can be obtained by the following procedure. That is, a round bar after spheroidizing annealing is cut at a D/4 position in parallel to the axial direction, a test piece for sulfide observation was collected, the test piece is buried in a resin, and thereafter a test surface parallel to the longitudinal direction of the steel for cold forging is polished. A predetermined position of the polished test piece is photographed at 100 times with a scanning electron microscope, and images of an inspection reference area of 0.9 $mm^2$ are prepared for 10 visual fields. That is, the observed visual field for the sulfides is 9 $mm^2$. In each observed region, sulfides are specified based on the contrast of backscattered electron images observed with the scanning electron microscope, and the grain size distribution of the sulfides having an equivalent circle diameter of 1.0 μm in the observed visual field is detected. By analyzing the image of the observed visual field, the number of sulfides can be obtained. In addition, the equivalent circle diameter can be obtained through conversion into the equivalent circle diameter representing the diameter of a circle having the same area as the area of the sulfide. In addition, regarding the average distance between the sulfides, the centroids of sulfides having an equivalent circle diameter of 1.0 μm or more are obtained from the observed visual field (image) from which the grain size distribution of the sulfides is detected, the centroid-to-centroid distance between each sulfide and another sulfide is measured, and the distance between each sulfide and the sulfide closest thereto is measured. Then, the actual measured values of the distances between the closest sulfides are measured for the all the sulfides in each visual field, and the average distance therebetween is used as the average distance between the sulfides.

[Expression (1)]

The solidification structure of a continuous cast piece usually has a dendrite morphology. Sulfides in steel tend to crystallize before solidification (in molten steel) or during solidification and are greatly affected by the dendrite primary arm spacing. That is, when the dendrite primary arm spacing is small, sulfides crystallized between the arms become small. Therefore, when the dendrite primary arm spacing of the cast piece of the steel is reduced to, for example, less than 600 μm to increase the proportion of fine sulfides crystallized from between the dendrite arms and sulfides of more than 10.0 μm are eliminated, the cold forgeability is improved. In the steel for cold forging according to this embodiment, variation of the equivalent circle diameters of the sulfides detected per 9 $mm^2$ of the observed visual field is calculated as the standard deviation σ, a value obtained by adding the average equivalent circle diameter d to 3σ of the standard deviation is used as the left side (Manufacturing method of a welded joint according to this embodiment) of Expression (1), and F1 is defined as Expression (1').

$$F1=d+3\sigma \quad (1')$$

Here, d and σ in Expression (1') are the same as d and σ in Expression (1). The F1 value represents the maximum equivalent circle diameter of 99.7% in number of sulfides among sulfides that are present in the steel for cold forging according to this embodiment and can be observed with an optical microscope, which is predicted from the equivalent circle diameters of the sulfides observed in a range of 9 $mm^2$ of the observed visual field, and the standard deviation of the sulfides. That is, when the F1 value is 10.0 μm or less, in the steel for cold forging according to this embodiment, sulfides having a maximum equivalent circle diameter of more than 10.0 μm are rarely present. As the amount of coarse sulfides having a maximum equivalent circle diameter of more than 10.0 μm decreases, the cold forgeability is improved. In addition, even when the distance between the sulfides is reduced in order to improve the chip disposability, the cold forgeability is not decreased. The equivalent circle diameter of the sulfides as observation targets is set to 1.0 μm or more because it is possible to statistically handle the size of grains and components with an actual general-purpose device, and there is a small effect on the cold forgeability and chip disposability even when smaller sulfides are controlled. The value of F1 is preferably less than 10.0 μm.

[Expression (2)]

On the other hand, in a case where a value obtained by dividing the number of sulfides having an equivalent circle diameter of 1.0 μm or more and less than 3.0 μm by the number of sulfides having an equivalent circle diameter of 1.0 μm or more among the observed sulfides is 0.30 or more, the chip disposability decreases. The number density is defined as the left side (F2) of Expression (2), and F2 is defined as Expression (2').

$$F2=SA/SB \quad (2')$$

Here, SA and SB are the same as SA and SB in Expression (2). When the F2 value is less than 0.30, the proportion or fine sulfides which are less likely to become a stress concentration source at the time of chip separation during cutting decreases, so that the chip disposability is improved. The equivalent circle diameter of the sulfides as observation targets is set to 1.0 μm or more because there is no effect on the cold forgeability and chip disposability even when smaller sulfides are controlled.

[Manufacturing Method]

A preferable manufacturing method of the steel for cold forging according to this embodiment will be described. The steel for cold forging according to this embodiment is not limited to the manufacturing method as long as the steel for cold forging has the above-described characteristics, but is preferably stably manufactured by continuously casting a cast piece having the above-described chemical composition and a dendrite primary arm spacing of less than 600 μm in a range of 15 mm from the surface, performing hot working and annealing on the cast piece. The hot working includes a hot working of forming the cast piece into a steel piece through forging, and/or a hot rolling of performing hot rolling on the cast piece or the steel piece. The annealing is preferably spheroidizing annealing.

[Casting]

A cast piece of steel satisfying the above chemical composition is manufactured by a continuous casting method. An ingot (steel ingot) may be formed by an ingot-making method. Examples of the casting conditions may include using a mold of 220×220 mm square, setting the superheat of the molten steel in a tundish to 10° C. to 50° C., and setting the casting speed to 1.0 to 1.5 m/min.

Furthermore, in order to control the dendrite primary arm spacing to be less than 600 μm, during casting of the molten steel having the chemical composition, it is desirable to set the average cooling rate in a temperature range from the liquidus temperature to the solidus temperature at a depth of 15 mm from the surface of the cast piece to 120° C./min to 500° C./min. When the dendrite primary arm spacing is less than 600 μm, sulfides are finely dispersed, which is advantageous for obtaining the sulfides of the steel for cold forging according to this embodiment described above. When an average cooling rate is less than 120° C./min, it is difficult to cause the dendrite primary arm spacing to be less than 600 μm at a depth position of 15 mm from the surface of the cast piece, and there is concern that the sulfides may not be finely dispersed. On the other hand, when an average cooling rate is more than 500° C./min, sulfides crystallized from between the dendrite arms become too fine and there is concern that the chip disposability may decrease.

The temperature range from the liquidus temperature to the solidus temperature is a temperature range from the start of solidification of the cast piece to the end of the solidification. Therefore, the average cooling temperature in this temperature range means an average solidification rate of the cast piece. The average cooling rate can be achieved by means such as controlling the size of the cross section of the mold, the casting speed, and the like to appropriate values, and increasing the amount of cooling water used for water cooling immediately after casting. This can be applied to both the continuous casting method and the ingot-making method.

The cooling rate at a depth position of 15 mm from the surface of the cast piece is the average value obtained by etching the cross section of the obtained cast piece, measuring 100 dendrite secondary arm spacings $\lambda_2$ (μm) at a pitch of 5 mm in the casting direction regarding each depth position of 15 mm from the surface of the cast piece, calculating the cooling rates A (° C./sec) in the temperature range from the liquidus temperature to the solidus temperature of a slab from the value based on Expression (C), and obtaining the arithmetical average thereof.

$$\lambda_2=710\times A-0.39 \quad \text{(C)}$$

Therefore, for example, the average cooling rate can be controlled by manufacturing a plurality of cast pieces with varying casting conditions in advance, obtaining the cooling rate of each of the cast pieces using the above expression, and determining optimum casting conditions from the obtained cooling rates.

In addition, in order to reduce center segregation, reduction may be added in a stage of solidification of the continuous casting.

[Hot Working]

In the hot working, the cast piece or ingot may be processed into steel by hot working such as hot forging, or the cast piece or ingot may be subjected to hot working to manufacture a billet (steel piece) and the billet may be hot rolled to obtain steel such as a steel bar or wire rod. The hot working and hot rolling may be performed by known methods depending on the required mechanical properties and the like.

[Annealing]

The manufactured steel such as a steel bar or wire rod is subjected to a spheroidizing annealing treatment. By the spheroidizing annealing treatment, the cold forgeability of the steel can be increased. The spheroidizing annealing can be performed by a known method.

In this manner, the steel for cold forging according to this embodiment is obtained.

[Manufacturing Method of Mechanical Component]

In addition, a mechanical component can be obtained from the steel for cold forging by manufacturing an intermediate article having a rough shape by cold forging the steel bar or wire rod (steel for cold forging) subjected to the spheroidizing annealing treatment, cutting the intermediate article into a predetermined shape through machining as necessary, further performing a surface-hardening treatment under known conditions, and cutting the intermediate article after the surface-hardening treatment into a predetermined shape through machining. The surface-hardening treatment may not be performed, but in a case where the surface-hardening treatment is performed, examples thereof include a carburizing treatment, a nitriding treatment, and induction hardening.

EXAMPLES

Steels A to Y having the chemical compositions shown in Table 1 were melted in a 270 ton converter and continuously cast using a continuous casting machine, thereby manufacturing cast pieces of 220×220 mm square. In addition, reduction was added in a stage of solidification of the continuous casting.

In the casing of each of the steels, the average cooling rate in a temperature range from the liquidus temperature to the solidus temperature at a position at a depth of 15 mm from the surface of the cast piece was changed by changing the amount of cooling water of the mold.

The steels A to L shown in Table 1 are steels having the chemical composition specified in the present invention. On the other hand, the steels M to Y are steels of comparative examples in which the chemical composition deviates from the conditions specified in the present invention. Underlines of numerical values in Table 1 indicate that the numerical values are outside the range of the present invention.

The cast pieces obtained by the continuous casting were once cooled to room temperature, and test pieces for dendrite structure observation were collected from the cooled cast pieces.

Thereafter, each of the cast pieces was heated at 1250° C. for two hours, the cast piece after being heated was subjected to hot forging, and was subjected to air cooling after the hot forging, thereby manufacturing a plurality of round bars having a diameter of 30 mm.

Next, a spheroidizing annealing treatment was performed on the round bars having a diameter of 30 mm. Specifically, the round bar was soaked at 1300° C. for one hour using a heating furnace. Next, the round bar was moved to another heating furnace and was soaked at 925° C. for one hour, and the round bar after the soaking was subjected to air cooling. Next, the round bar was heated again and was soaked at 765° C. for 10 hours. After the soaking, the round bar was cooled to 650° C. at a cooling rate of 15° C./h. Thereafter, the round bar was subjected to air cooling. In this manner, steels for cold forging of Test Nos. 1 to 27 were manufactured.

These were subjected to observation of microstructures and sulfides, a cold forgeability test, and a machinability test.

[Solidification Structure Observation Method]

Regarding the solidification structure, the cross section of the cast piece was etched with picric acid, and 100 dendrite primary arm spacing were measured at a pitch of 5 mm at a position of 15 mm from the surface of the cast piece in the casting direction, and the average value thereof was obtained.

[Microstructure Observation Method]

The microstructure of the round bar after the spheroidizing annealing treatment was observed. The round bar was cut at a D/4 position in parallel to the axial direction, and a test piece for microstructure observation was collected. The cut surface of the test piece was polished and corroded with Nital etchant, and after the corrosion, the microstructure of the center portion of the cut surface was observed at 400 times with an optical microscope. The microstructures of the round bars of all the test numbers were structures in which spherical cementite was dispersed in ferrite.

Furthermore, a Vickers hardness test specified in JIS Z 2244 was conducted using the test piece for microstructure observation. As a result of measuring the hardness at five points, the Vickers hardness of each of the round bars was in a range of Hv 100 to 140, and the round bars had the same degree of hardness.

[Sulfide Observation Method]

The round bar after the spheroidizing annealing was cut at a D/4 position in parallel to the axial direction, and a test piece for sulfide observation was collected. The test piece was buried in a resin and a test surface was mirror polished. The test surface is parallel to the longitudinal direction of the steel for cold forging. Sulfides in the test surface were specified with a scanning electron microscope and an energy dispersive X-ray spectrometer (EDS). Specifically, 10 polished test pieces of 10 mm in length×10 mm in width were manufactured, the polished test pieces were photographed at 100 times with the scanning electron microscope, and images of an inspection reference area (region) of 0.9 $mm^2$ were prepared for 10 visual fields. That is, the observed visual field for the sulfides is 9 $mm^2$. In each observed region, sulfides were specified based on the contrast of backscattered electron images observed with the scanning electron microscope, and whether or not the sulfides are predetermined sulfides were confirmed with the EDS. In the backscattered electron image, the observed regions were displayed as gray scale images. The contrasts of the matrix (primary phase), sulfides, and oxides, in the backscattered electron image were different from each other. The grain size distribution of sulfides having an equivalent circle diameter of 1.0 μm or more in the observed visual field were detected. These dimensions (diameter) were converted into equivalent circle diameters indicating the diameters of circles having the same area as the area of the sulfides. From the detected grain size distribution of the sulfides, the average equivalent circle diameter and standard deviation of the sulfides were calculated.

Regarding the average distance between the sulfides, the centroids of sulfides having an equivalent circle diameter of 1.0 μm or more were obtained from the observed visual field (image) from which the grain size distribution of the sulfides was detected, the centroid-to-centroid distance between each sulfide and another sulfide was measured, and the distance between each sulfide and the sulfide closest thereto was measured. Then, the actual measured values of the distances between the closest sulfides were measured for the all the sulfides in each visual field, and the average distance therebetween was used as the average distance between the sulfides.

Table 2 shows F1 values, F2 values, the number density of sulfides of 1.0 to 10.0 μm, and the distance between sulfides. Here, underlines in Table 1 indicate outside the range of the present invention.

[Cold Forgeability Test]

Around bar test piece was manufactured from the R/2 position of the round bar having a diameter of 30 mm after the spheroidizing annealing. The round bar test piece was a test piece which has a diameter of 10 mm and a length of 15 mm and the center thereof is set as the R/2 position of the round bar having a diameter of 30 mm. The longitudinal direction of the round bar test piece was parallel to the forging axis of the round bar having a diameter of 30 mm For each of the steels, eight round bar test pieces were manufactured. For a cold compression test, a 500 ton hydraulic press was used. Cold compression was performed by gradually increasing the compression ratio using the eight round bar test pieces. Specifically, the eight round bar test pieces were subjected to cold compression at an initial compression rate. After the cold compression, whether or not cracking had occurred in each of the round bar test pieces was visually checked. After excluding the round bar test pieces where cracking was confirmed, the remaining round bar test pieces (that is, the round bar test pieces where no cracking was observed) were subjected to cold compression again by increasing the compression ratio. After the cold compression, the presence or absence of cracking was confirmed. After excluding the round bar test pieces where cracking was confirmed, the remaining round bar test pieces were subjected to cold compression again by increasing the compression ratio. The above process was repeated until four round bar test pieces with cracking confirmed among the eight test pieces. The compression ratio when cracking was confirmed in the four round bar test pieces among the eight test pieces was defined as "limit compression ratio". After cold compression was performed at a compression ratio of 80%, in a case where the number of round bar test pieces where cracking was confirmed was four or less, the limit compression ratio of the steel was set to "80%".

The aim of the cold forgeability was set to 75% or more at which there is no practical problem in terms of limit compression ratio.

[Machinability Test]

Regarding each of the steels, using the remaining steel bars having a diameter of 30 mm, which were subjected to the spheroidizing annealing, strain was imparted by cold drawing instead of cold forging, and from machinability after the drawing, the machinability after the cold forging was evaluated.

Specifically, the remaining round bar steels having a diameter of 30 mm, which were subjected to the spheroidizing annealing, were subjected to cold drawing at a reduction of area of 30.6%, thereby obtaining steel bars having a diameter of 25 mm. The cold drawn steel bars were cut into a length of 500 mm, thereby obtaining test materials for turning.

The outer circumferential portion of the test material having a diameter of 25 mm and a length of 500 mm obtained as described above was subjected to turning using an NC lathe under the following conditions to examine chip disposability as the machinability.

The chip disposability was evaluated by the following method. Chips discharged during the machinability test for 10 seconds were collected. The lengths of the collected chips were examined, and 10 chips were selected in descending order of the lengths. The total weight of the 10 chips selected was defined as "chip weight". In a case where chips become long and the number of chips was less than 10, the total weight of the recovered chips was measured, and a value converted into the number of the 10 chips was defined as "chip weight". For example, in a case where the total number of chips was 7 and the total weight thereof was 12 g, the chip weight was calculated as 12 g×10/7.

<Chip Used>

Base metal material: Carbide P20 type grade

Coating: None

<Turning Conditions>

Circumferential speed: 150 m/min

Feed: 0.2 mm/rev

Depth of cut: 0.4 mm

Lubrication: Water-soluble cutting oil was used.

When the chip weight was 15 g or less, it was determined that chip disposability was high. In a case where the chip weight exceeded 15 g, it was evaluated that chip disposability was low.

As shown in Tables 1 and 2, the test pieces of the steels (the steels A to L) of Test Nos. 1 to 12 were within the range of the chemical composition of the steel for cold forging of the present invention, Expression (1) and Expression (2) were satisfied, and the number density of the sulfides of 1.0 to 10.0 μm and the distance between the sulfides were within the range of the present invention. As a result, the steels of Test Nos. 1 to 12 had excellent cold forgeability and machinability after cold forging.

The steel of Test No. 13 was within the range of the test piece of the present invention. However, since the cooling rate during casting was too fast, a large amount of fine Mn sulfides was formed, and Expression (2) was not satisfied. As a result, the Mn sulfides did not accomplish the notch effect during cutting, so that the chip weight exceeded 15 g.

The steel of Test No. 14 was within the range of the chemical composition of the steel for cold forging according to this embodiment. However, since the cooling rate during casting was slow, the number of sulfides of 1.0 to 10.0 μm was small. In addition, the average distance between the sulfides was 30.0 μm or more. As a result, the machinability was low.

Test No. 15 and Test No. 16 did not contain Bi and the S content was less than the lower limit of the specified value. Therefore, although the equivalent circle diameters of the formed sulfides were small and satisfied Expression (1), since the number of sulfides of 1.0 to 10.0 μm was small and the average distance between the sulfides was 30.0 μm or more, the machinability was low while the cold forgeability was high. Specifically, the chip weight exceeded 15 g.

Test Nos. 17 to 20 did not contain Bi. Therefore, Expression (1) was not satisfied. Coarse sulfides were present, and the number of sulfides of 1.0 to 10.0 μm was small, so that the cold forgeability was lower than the reference value.

Test No. 21 contained Bi, but the S content exceeded the upper limit of the specified value. As a result, the dendrite primary arm spacing did not satisfy Expression (1) although the dendrite primary arm spacing was the specified value or less, so that the cold forgeability was lower than the reference value. It is presumed that the cold forgeability was lower than the reference value because the S content was large and coarse sulfides were present.

Test No. 22 and Test No. 23 contained Bi, but the S content was equal to or lower than the lower limit of the specified value. As a result, although Expression (1) was satisfied and the cold forgeability was the reference value or higher, Expression (2) was not satisfied, there were a large number of sulfides having an equivalent circle diameter of less than 3 μm, and the average distance between the sulfides was 30 μm or more. Therefore, the chip weight exceeded 15 g.

Test No. 24 and Test No. 25 contained Bi, but the S content exceeded the upper limit of the specified value. As a result, although the dendrite primary arm spacing was the specified value or less, Expression (1) was not satisfied. Therefore, the cold forgeability was lower than the reference value.

In Test No. 26, the Bi content exceeded the upper limit of the specified value. As a result, although Expression (1) was satisfied and the cold forgeability was the specified value or more, Expression (2) was not satisfied. Therefore, there were a large number of sulfides having an equivalent circle diameter of less than 3 μm, and the chip weight exceeded 15 g.

Test No. 27 did not contain Bi. Therefore, the number of sulfides of 1.0 to 10.0 μm was small, and the average distance between the sulfides was 30.0 μm or more. As a result, although the cold forgeability was high, the machinability was low. Specifically, the chip weight exceeded 15 g.

While the embodiment of the present invention has been described above, the above-described embodiment is merely an example for implementing the present invention. Therefore, the present invention is not limited to the above-described embodiment, and the above-described embodiment can be appropriately modified and implemented without departing from the gist of the invention.

TABLE 1

| | Chemical composition (mass %) remainder: Fe and impurities | | | | | | | | | | | | | | | | | Re- |
|---|---|---|---|---|---|---|---|---|---|---|---|---|---|---|---|---|---|---|
| Steel | C | Si | Mn | P | S | Ni | Cr | Bi | Mo | Al | Nb | V | Ti | B | Mg | N | O | marks |
| A | 0.20 | 0.24 | 0.80 | 0.015 | 0.008 | — | 1.20 | 0.0020 | — | 0.035 | — | — | — | — | — | 0.0124 | 0.0010 | Invention steel |
| B | 0.23 | 0.20 | 1.02 | 0.011 | 0.009 | — | 1.19 | 0.0003 | — | 0.032 | — | — | — | — | — | 0.0125 | 0.0010 | |
| C | 0.19 | 0.18 | 0.84 | 0.013 | 0.008 | — | 1.15 | 0.0048 | — | 0.041 | — | — | 0.018 | — | — | 0.0222 | 0.0009 | |
| D | 0.18 | 0.07 | 0.95 | 0.015 | 0.015 | — | 0.67 | 0.0018 | — | 0.022 | — | — | — | — | — | 0.0145 | 0.0011 | |
| E | 0.18 | 0.40 | 0.87 | 0.019 | 0.016 | — | 1.51 | 0.0006 | — | 0.031 | 0.029 | — | — | 0.0015 | 0.0010 | 0.0096 | 0.0010 | |
| F | 0.21 | 0.24 | 0.85 | 0.014 | 0.016 | — | 1.89 | 0.0040 | 0.21 | 0.028 | — | 0.05 | — | — | — | 0.0131 | 0.0018 | |
| G | 0.19 | 0.26 | 0.64 | 0.013 | 0.021 | 0.30 | 1.34 | 0.0021 | 0.15 | 0.033 | — | — | — | — | — | 0.0114 | 0.0008 | |
| H | 0.22 | 0.41 | 0.81 | 0.014 | 0.025 | — | 1.45 | 0.0004 | 0.20 | 0.040 | — | — | — | — | — | 0.0124 | 0.0011 | |
| I | 0.24 | 0.21 | 0.64 | 0.015 | 0.023 | — | 1.67 | 0.0045 | 0.25 | 0.035 | — | — | 0.028 | — | 0.0011 | 0.0123 | 0.0008 | |
| J | 0.18 | 0.30 | 0.94 | 0.015 | 0.034 | 0.10 | 2.01 | 0.0020 | — | 0.031 | — | — | — | — | — | 0.0142 | 0.0009 | |
| K | 0.19 | 0.27 | 1.12 | 0.014 | 0.039 | — | 1.90 | 0.0001 | — | 0.024 | — | — | — | 0.0016 | — | 0.0117 | 0.0011 | |
| L | 0.21 | 0.18 | 0.81 | 0.015 | 0.038 | — | 1.21 | 0.0050 | — | 0.034 | — | — | — | — | — | 0.0145 | 0.0009 | |
| M | 0.21 | 0.24 | 0.84 | 0.014 | 0.002 | — | 1.14 | 0.0000 | — | 0.026 | — | — | — | — | — | 0.0126 | 0.0012 | Comparative steel |
| N | 0.19 | 0.21 | 0.94 | 0.013 | 0.006 | — | 1.19 | 0.0000 | — | 0.035 | — | — | — | — | — | 0.0126 | 0.0010 | |
| O | 0.25 | 0.26 | 1.01 | 0.014 | 0.016 | 0.11 | 1.15 | 0.0000 | — | 0.031 | — | — | — | — | — | 0.0134 | 0.0011 | |
| P | 0.19 | 0.19 | 1.12 | 0.015 | 0.026 | — | 1.34 | 0.0000 | 0.21 | 0.034 | 0.024 | — | — | — | — | 0.0094 | 0.0008 | |
| Q | 0.23 | 0.24 | 0.87 | 0.014 | 0.035 | — | 1.24 | 0.0000 | — | 0.024 | — | — | — | 0.0016 | — | 0.0126 | 0.0010 | |
| R | 0.19 | 0.17 | 1.32 | 0.013 | 0.045 | — | 1.94 | 0.0000 | — | 0.031 | — | — | 0.020 | — | 0.0021 | 0.0097 | 0.0018 | |
| S | 0.24 | 0.15 | 0.85 | 0.015 | 0.043 | — | 1.25 | 0.0004 | 0.14 | 0.035 | — | 0.02 | — | — | — | 0.0125 | 0.0014 | |
| T | 0.23 | 0.16 | 0.86 | 0.014 | 0.004 | — | 1.38 | 0.0045 | 0.21 | 0.028 | — | — | — | — | — | 0.0135 | 0.0016 | |
| U | 0.20 | 0.21 | 1.32 | 0.013 | 0.003 | — | 1.87 | 0.0024 | — | 0.033 | — | — | 0.015 | — | 0.0004 | 0.0142 | 0.0017 | |
| V | 0.19 | 0.21 | 1.4 | 0.014 | 0.043 | — | 1.23 | 0.0048 | 0.09 | 0.032 | 0.005 | 0.03 | — | 0.0014 | — | 0.0123 | 0.0016 | |
| W | 0.21 | 0.24 | 1.64 | 0.015 | 0.045 | 0.12 | 1.64 | 0.0026 | — | 0.022 | — | — | — | — | — | 0.0095 | 0.0009 | |
| X | 0.25 | 0.29 | 0.98 | 0.013 | 0.015 | — | 1.57 | 0.0062 | 0.15 | 0.031 | — | — | — | — | — | 0.0105 | 0.0015 | |
| Y | 0.21 | 0.24 | 0.81 | 0.015 | 0.010 | — | 1.15 | 0.0000 | — | 0.029 | — | — | — | — | — | 0.0125 | 0.0011 | |

The underlined indicate outside the condition specified in the present invention.

TABLE 2

| Test No. | Steel | Cooling rate at depth of 15 mm (°C./min) | Dendrite primary arm spacing (μm) | Expression (1) F1 | Expression (2) F2 | Number of sulfides of 1 to 10 μm (/mm2) | Distance between sulfides (μm) | Cold forgeability Limit compression ratio(%) | Machinability Chip disposability | Remarks |
|---|---|---|---|---|---|---|---|---|---|---|
| 1 | A | 170 | 520 | 6.9 | 0.15 | 1830 | 26.4 | 80 | ≤15 g | Invention |
| 2 | B | 120 | 579 | 7.2 | 0.16 | 1820 | 27.9 | 80 | ≤15 g | Example |
| 3 | C | 240 | 445 | 5.4 | 0.12 | 1835 | 21.7 | 80 | ≤15 g | |
| 4 | D | 160 | 529 | 7.4 | 0.13 | 1760 | 25.4 | 80 | ≤15 g | |
| 5 | E | 120 | 574 | 7.8 | 0.11 | 1755 | 27.5 | 80 | ≤15 g | |
| 6 | F | 250 | 432 | 6.3 | 0.10 | 1741 | 21.3 | 80 | ≤15 g | |
| 7 | G | 180 | 512 | 7.5 | 0.11 | 1658 | 23.6 | 80 | ≤15 g | |
| 8 | H | 150 | 548 | 8.6 | 0.11 | 1659 | 25.6 | 80 | ≤15 g | |
| 9 | I | 250 | 420 | 6.3 | 0.08 | 1674 | 19.3 | 80 | ≤15 g | |
| 10 | J | 180 | 513 | 8.2 | 0.07 | 1598 | 21.2 | 80 | ≤15 g | |
| 11 | K | 120 | 574 | 9.3 | 0.08 | 1554 | 24.0 | 80 | ≤15 g | |
| 12 | L | 240 | 443 | 6.6 | 0.04 | 1562 | 16.1 | 80 | ≤15 g | |
| 13 | A | 550 | 310 | 3.5 | * 0.40 | 1151 | 12.3 | 80 | >15 g | Comparative |
| 14 | A | 100 | 606 | 8.6 | 0.23 | 1132 | 33.4 | 80 | >15 g | Example |
| 15 | M | 90 | 614 | 8.8 | 0.22 | 1095 | 34.3 | 80 | >15 g | |
| 16 | N | 90 | 615 | 9.7 | 0.21 | 1045 | 32.3 | 80 | >15 g | |
| 17 | O | 95 | 612 | * 11.0 | 0.10 | 978 | 29.6 | 74 | ≤15 g | |
| 18 | P | 85 | 614 | * 12.5 | 0.07 | 964 | 26.2 | 65 | ≤15 g | |
| 19 | Q | 80 | 621 | * 13.9 | 0.05 | 915 | 23.1 | 54 | ≤15 g | |
| 20 | R | 70 | 634 | * 15.5 | 0.02 | 920 | 19.7 | 51 | ≤15 g | |
| 21 | S | 200 | 496 | * 10.5 | 0.05 | 1840 | 21.6 | 73 | ≤15 g | |
| 22 | T | 250 | 431 | 6.0 | * 0.32 | 1906 | 30.9 | 80 | >15 g | |
| 23 | U | 180 | 512 | 6.5 | * 0.34 | 1741 | 31.4 | 80 | >15 g | |
| 24 | V | 270 | 412 | * 10.6 | 0.04 | 1520 | 15.6 | 74 | ≤15 g | |
| 25 | W | 170 | 524 | * 11.7 | 0.04 | 1530 | 18.2 | 71 | ≤15 g | |
| 26 | X | 290 | 395 | 7.6 | * 0.31 | 1740 | 18.5 | 80 | >15 g | |
| 27 | Y | 160 | 604 | 8.4 | 0.22 | 1120 | 31.5 | 80 | >15 g | |

The underlined indicate outside the condition specified in the present invention.
* indicate that Expression (1) and Expression (2) are not satisfied.

INDUSTRIAL APPLICABILITY

With the steel for cold forging and the manufacturing method thereof according to the present invention, the proportion of machining costs to the manufacturing costs of steel product components such as gears, shafts, and pulleys for automobiles and industrial machinery can be reduced, and the quality of the components can be improved. In addition, a steel for cold forging excellent in machinability after cold forging, that is, machinability before carburizing, carbonitriding, or nitriding, which becomes the material of steel product components such as gears, shafts, and pulleys can be obtained. Therefore, high industrial applicability is obtained.

What is claimed is:

1. A steel for cold forging comprising, as a chemical composition, by mass %, C: 0.05% to 0.30%,
Si: 0.05% to 0.45%,
Mn: 0.40% to 2.00%,
S: 0.008% to less than 0.040%,
Cr: 0.01% to 3.00%,
Al: 0.010% to 0.100%,
Bi: 0.0001% to 0.0050%,
Mo: 0% to 1.00%,
Ni: 0% to 1.00%,
V: 0% to 0.30%,
B: 0% to 0.0200%,
Mg: 0% to 0.0035%,
Ti: 0% to 0.060%,
Nb: 0% to 0.080%, and
a remainder of Fe and impurities,
wherein N, P, and O contained in the impurities are as follows
N: 0.0250% or less,
P: 0.050% or less, and
O: 0.0020% or less,
1200/mm$^2$ or more of sulfides having an equivalent circle diameter of 1.0 to 10.0 μm are contained in a microstructure,
an average distance between the sulfides is less than 30.0 μm, and
the sulfides in the microstructure satisfy Expression (1) and Expression (2):
$d+3\sigma \leq 10.0$ . . . (1)
$SA/SB < 0.30$ . . . (2),
in Expression (1), d is an average value of equivalent circle diameters of the sulfides having an equivalent circle diameter of 1.0 μm or more, σ is a standard deviation of the equivalent circle diameters of the sulfides having the equivalent circle diameter of 1.0 μm or more, in Expression (2), SA is a number of sulfides having the equivalent circle diameter of 1.0 μm or more and less than 3.0 μm, and SB is a number of sulfides having an equivalent circle diameter of 1.0 μm or more.

2. The steel for cold forging according to claim 1, comprising, as the chemical composition, by mass %, one or more of:

Mo: 0.02% to 1.00%,
Ni: 0.10% to 1.00%,
V: 0.03% to 0.30%,
B: 0.0005% to 0.0200%, and
Mg: 0.0001% to 0.0035%.

3. The steel for cold forging according to claim 1, comprising, as the chemical composition, by mass %, one or two of:

Ti: 0.007% to 0.060%, and
Nb: 0.010% to 0.080%.

4. The steel for cold forging according to claim comprising, as the chemical composition, by mass %, one or two of:

Ti: 0.002% to 0.060%, and

Nb: 0.010% to 0.080%.

5. A manufacturing method of a steel for cold forging, comprising:

casting a cast piece having the chemical composition according to claim 1, and having a dendrite primary arm spacing of less than 600 μm in a range of 15 mm from a surface of the cast piece;

performing a hot working on the cast piece to obtain a steel material; and annealing the steel material.

6. The manufacturing method of a steel for cold forging according to claim 5, wherein, in the casting, an average cooling rate in a temperature range from a liquidus temperature to a solidus temperature at a depth of 15 mm from the surface of the cast piece is set to 120° C./min to 500° C./min.

* * * * *